US012336583B2

(12) United States Patent
Lewis

(10) Patent No.: US 12,336,583 B2
(45) Date of Patent: Jun. 24, 2025

(54) MULTI-PURPOSE BONNET STYLED BASEBALL CAP HEAD COVERING

(71) Applicant: Danielle Lewis, Fayetteville, GA (US)

(72) Inventor: Danielle Lewis, Fayetteville, GA (US)

( * ) Notice: Subject to any disclaimer, the term of this patent is extended or adjusted under 35 U.S.C. 154(b) by 0 days.

(21) Appl. No.: 18/119,657

(22) Filed: Mar. 9, 2023

(65) Prior Publication Data

US 2023/0284725 A1 Sep. 14, 2023

Related U.S. Application Data

(60) Provisional application No. 63/319,407, filed on Mar. 14, 2022.

(51) Int. Cl.

| | |
|---|---|
| ***A42B 1/0182*** | (2021.01) |
| ***A42B 7/00*** | (2006.01) |
| ***A45D 8/40*** | (2006.01) |
| *A42B 1/02* | (2006.01) |
| *A42B 1/04* | (2021.01) |
| *A42B 1/201* | (2021.01) |
| *A42B 1/206* | (2021.01) |
| *A42B 1/22* | (2006.01) |

(52) U.S. Cl.

CPC ..... *A42B 1/0182* (2021.01); *A42B 7/00* (2013.01); *A45D 8/40* (2013.01); *A42B 1/02* (2013.01); *A42B 1/04* (2013.01); *A42B 1/201* (2013.01); *A42B 1/206* (2013.01); *A42B 1/22* (2013.01)

(58) Field of Classification Search

CPC ..... A42B 1/0182; A42B 1/02; A42B 1/04; A42B 1/201; A42B 1/206; A42B 1/22; A42B 7/00; A45D 8/40

USPC ..... 2/204

See application file for complete search history.

(56) References Cited

U.S. PATENT DOCUMENTS

| | | | | | |
|---|---|---|---|---|---|
| 5,450,629 | A * | 9/1995 | Gilstrap | A45F 4/02 | 2/209.12 |
| 5,845,338 | A * | 12/1998 | Clark | A42B 1/206 | 2/171.1 |
| 5,983,398 | A * | 11/1999 | Kronenberger | A42B 1/22 | 2/181 |
| 6,467,096 | B1 * | 10/2002 | Coluccio | A42B 1/22 | 2/195.2 |
| 9,439,466 | B2 * | 9/2016 | Woo | A41D 15/00 | |
| 10,051,907 | B2 * | 8/2018 | Dammann | A42B 1/12 | |
| 11,666,110 | B1 * | 6/2023 | Panzer | A42B 1/041 | 2/183 |
| 11,700,900 | B2 * | 7/2023 | McCarty | A42B 1/205 | 2/195.1 |
| 2002/0029404 | A1 * | 3/2002 | Friedman | A42B 1/22 | 2/195.2 |
| 2005/0086727 | A1 * | 4/2005 | Shen | A42B 1/08 | 2/425 |

(Continued)

*Primary Examiner* — Khaled Annis
*Assistant Examiner* — Dakota Marin
(74) *Attorney, Agent, or Firm* — The Law Firm of Andrea Hence Evans, LLC

(57) ABSTRACT

A multi-purpose bonnet styled baseball cap head covering is provided. The multi-purpose bonnet styled baseball cap head covering combines the functionality of a satin bonnet and a baseball style cap. The multi-purpose bonnet styled baseball cap head covering is configured to protect and maintain hair by providing the style of a chic baseball hat front view. The multi-purpose bonnet styled baseball cap head covering comprises a bonnet styled portion with a combo baseball cap style hat band.

10 Claims, 3 Drawing Sheets

(56) References Cited

U.S. PATENT DOCUMENTS

| | | | | |
|---|---|---|---|---|
| 2010/0186147 | A1* | 7/2010 | Garza | A42B 1/205 2/244 |
| 2012/0317699 | A1* | 12/2012 | Barr | A42B 1/201 2/209.13 |
| 2019/0380414 | A1* | 12/2019 | Hinds | A42C 5/02 |

* cited by examiner

MULTI-PURPOSE BONNET STYLED BASEBALL CAP HEAD COVERING

CROSS-REFERENCE TO RELATED APPLICATIONS

Under provisions of 35 U.S.C. § 119(e), the Applicant claim the benefit of U.S. provisional application No. 63/319,407, filed Mar. 15, 2022, which is incorporated herein by reference.

It is intended that each of the referenced applications may be applicable to the concepts and embodiments disclosed herein, even if such concepts and embodiments are disclosed in the referenced applications with different limitations and configurations and described using different examples and terminology.

STATEMENT REGARDING FEDERALLY SPONSORED RESEARCH OR DEVELOPMENT

None.

FIELD

The disclosure relates to head coverings, hats, caps, including form-fitting or self-adjusting head coverings. The disclosure also relates to soft head coverings and devices for reducing hat size or securing. The disclosure relates to improved components for these and other devices and systems.

BACKGROUND

There are many scenarios in which individuals cover their hair. For grooming, protection against damage, and other purposes a man or woman may need to cover their hair. Typically, this is done at nighttime to protect hair styles while sleeping. This is also done to prevent damage that may occur to the hair during the night. Conventionally silk or satin bonnets and head coverings are used to perform these tasks. Different scenarios exist which require hair protection in various ways outside of the bedroom or the privacy of one's home. Existing approaches may not be suitably stylish, efficient or effective.

Accordingly, there is a need for new versatile head coverings to fit the various scenarios. The present invention addresses this unmet need.

SUMMARY

In general, the disclosure provides a multi-purpose bonnet styled baseball cap head covering with components which combines the functionality of a satin bonnet and a baseball style cap. Further, the disclosure relates to a multi-purpose bonnet styled baseball cap head covering designed to protect and maintain hair by providing the style of a chic baseball hat front view. The disclosure relates to a multi-purpose bonnet styled baseball cap head covering having a bonnet styled portion with a combo baseball cap style hat band.

The multi-purpose bonnet styled baseball cap head covering can be configured to allow a wearer to put their hair under the combo baseball cap style hat band and cover the head with the bonnet styled portion. In at least one embodiment, the multi-purpose bonnet styled baseball cap head covering can be configured with an adjustable drawstring that closes the multi-purpose bonnet styled baseball cap head covering around the wearer's head. In at least one embodiment, the multi-purpose bonnet styled baseball cap head covering can be configured without an adjustable drawstring that closes the multi-purpose bonnet styled baseball cap head covering around the wearer's head. In at least one instance, the multi-purpose bonnet styled baseball cap head covering can be pre-sized and not have a drawstring. In at least one embodiment, the multi-purpose bonnet styled baseball cap head covering comprises a satin lined interior and an elastic band for the bottom surface of the multi-purpose bonnet styled baseball cap head covering.

The invention generally relates to multi-purpose bonnet styled baseball cap head covering which may be manufactured with appropriate materials and processes, and which may be scaled as needed to accommodate a variety of hair styles, hair types, head shapes, and head sizes.

Other objects, features, and advantages of the invention will become apparent from the following detailed description taken in conjunction with the accompanying drawings.

BRIEF DESCRIPTION OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
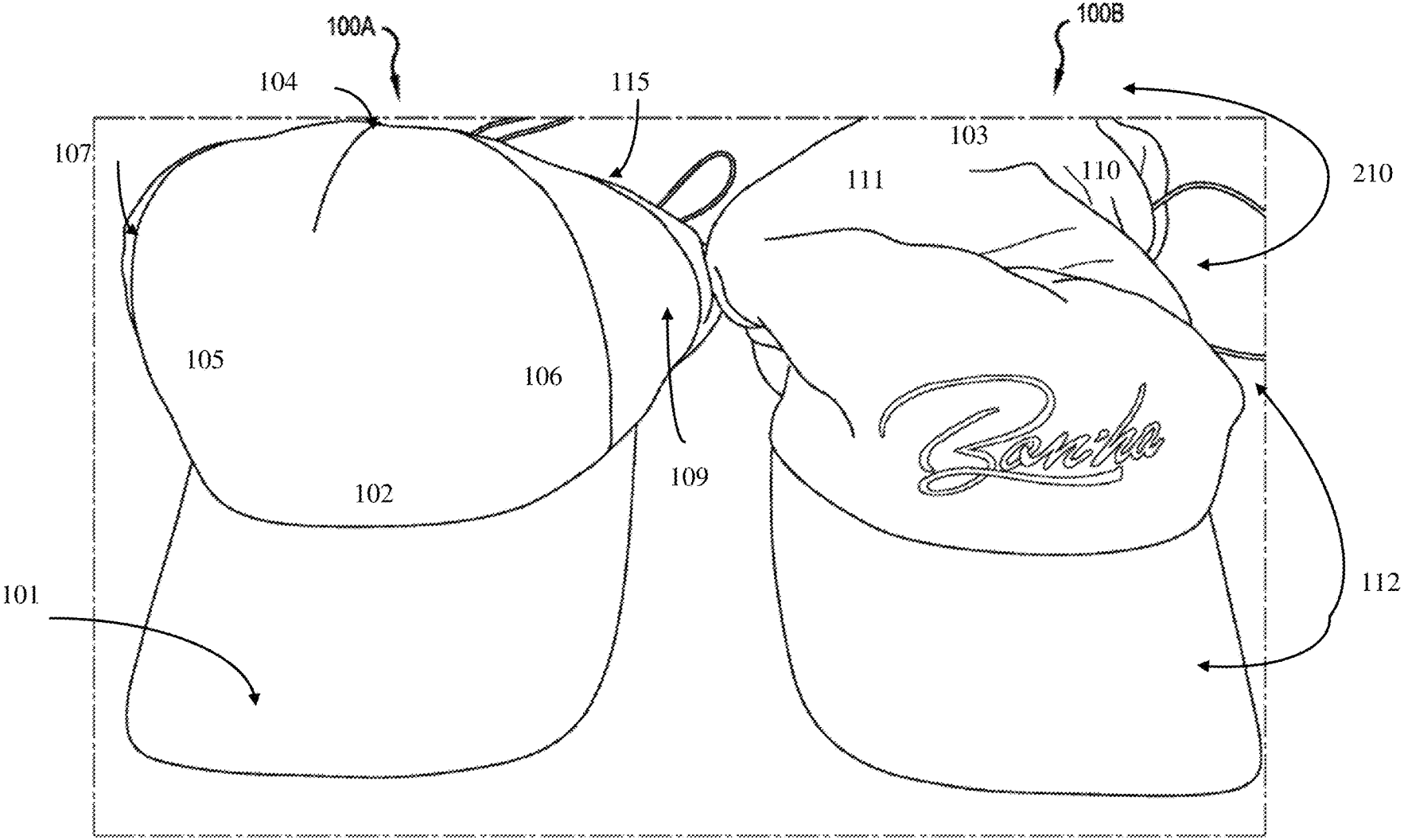
FIG. 1 depicts a perspective view of an exemplary multi-purpose bonnet styled baseball cap head covering.

Reference is made herein to the attached drawings. Like reference numerals may be used in the drawings to indicate like or similar elements of the description. The figures are intended for representative purposes and should not be considered limiting.

The present disclosure can be understood more readily by reference to the following detailed description of the present disclosure and the examples included therein.

Before the present articles, systems, devices, and/or methods are disclosed and described, it is to be understood that they are not limited to specific implementations unless otherwise specified, or to particular approaches unless otherwise specified, as such can, of course, vary. It is also to be understood that the terminology used herein is for the purpose of describing aspects only and is not intended to be limiting. Although any methods and materials similar or equivalent to those described herein can be used in the practice or testing of the present disclosure, example methods and materials are now described.

All publications mentioned herein are incorporated herein by reference to disclose and describe the methods and/or materials in connection with which the publications are cited.

Definitions

It is to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this present disclosure belongs. In this specification and in the claims which follow, reference will be made to a number of terms which shall be defined herein.

As used in the specification and the appended claims, the singular forms "a," "an," and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey those similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the present disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the present disclosure. Thus, if there are a variety of additional steps that can be performed it is understood that each of these additional steps can be performed with any specific aspect or combination of aspects of the methods of the present disclosure.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Multi-Purpose Bonnet Styled Baseball Cap Head Covering and Components

Referring now to FIG. 1, there is depicted a perspective view of an exemplary multi-purpose bonnet styled baseball cap head covering 100. FIG. 1 shows two styles of the multi-purpose bonnet styled baseball cap head covering 100A and 100B. The disclosure provides a multi-purpose bonnet styled baseball cap head covering 100 with components which combines the functionality of a satin bonnet and a baseball style cap. For example, there front portion 112 of the multi-purpose bonnet styled baseball cap head covering 100 shown in FIG. 1 has the following components: a brim/visor portion 101, a front panel 102, a back panel 103, an apex 104, and a closure 115. In one or more embodiments, multi-purpose bonnet styled baseball cap head covering 100 may be configured with a brim/visor portion, a front right panel 105, a front left panel 106, a right panel 107, a left panel 109, a back left panel 110, and a back right panel 111. The multi-purpose bonnet styled baseball cap head covering 100 is designed to protect and maintain hair by providing the style of a chic baseball hat front view as shown in FIG. 1.

Figure 2:
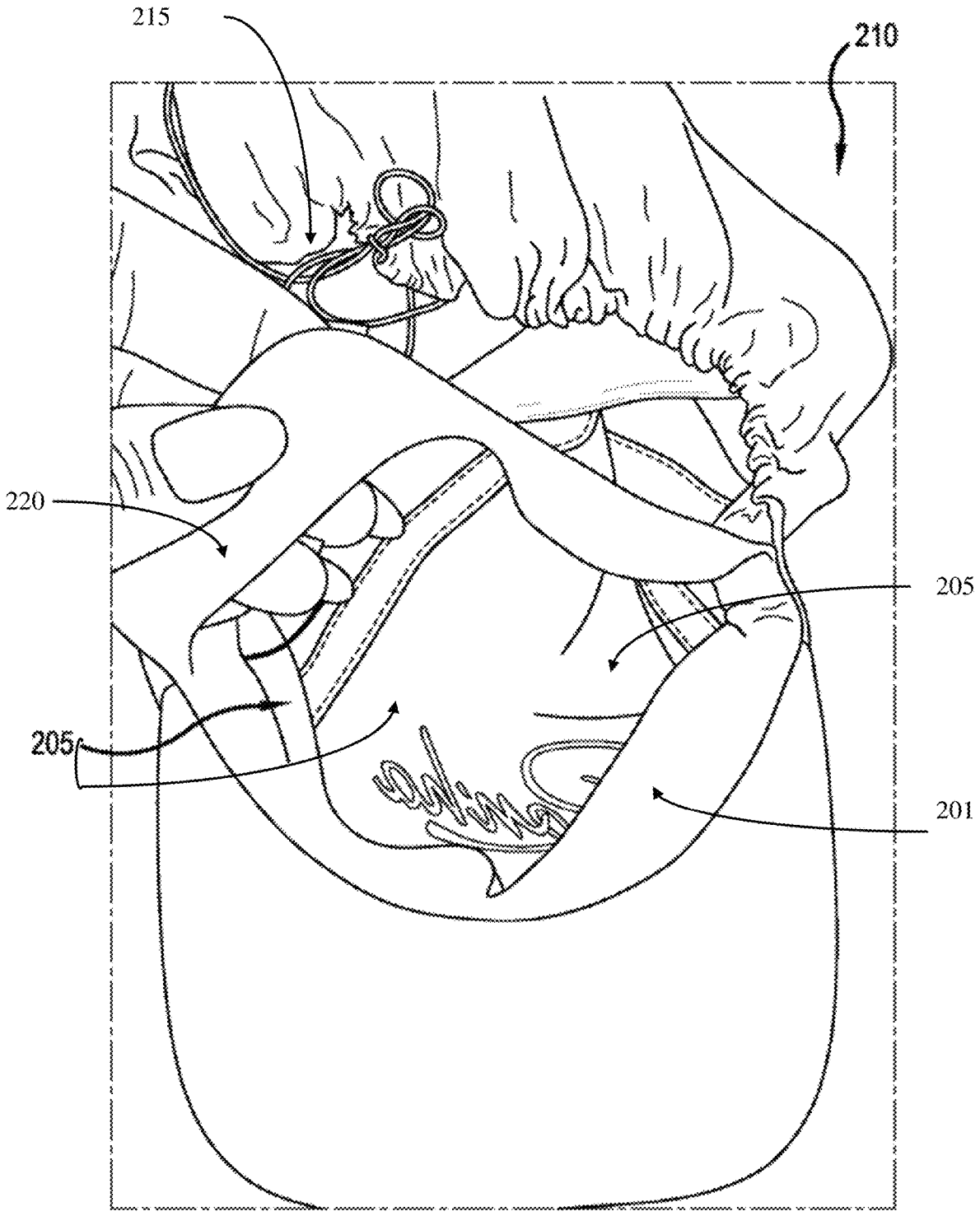
FIG. 2 depicts a bottom view of an exemplary multi-purpose bonnet styled baseball cap head covering.

Referring now to FIG. 2, there is depicted a bottom view of an exemplary multi-purpose bonnet styled baseball cap head covering. FIG. 2 shows an under peak, a satin lining 205, a bonnet styled rear portion 210, and a hat band 220 (referenced in FIG. 3, hat band 220 is being held in FIG. 2). In one or more embodiments, hat band 220 may comprise satin, a satin blend, a rayon, a silk, a silk blend, a synthetic satin and the likeness thereof. As such, multi-purpose bonnet styled baseball cap head covering 100 can be configured to provide a wearer with a combo baseball cap for use with longer hair via hat band 220. In at least one embodiment, the multi-purpose bonnet styled baseball cap head covering 100 can be configured to allow a wearer to put their hair under the combo baseball cap style hat band 220 and cover the head with the bonnet styled rear portion 210. The back of the cap is sized to receive the hair of the user. Specifically, the back of the cap is expansive and extends parallel to the neck of the user, to form a bonnet. The cap transitions from a baseball style cap in the front and a bonnet design in the back.

Figure 3:
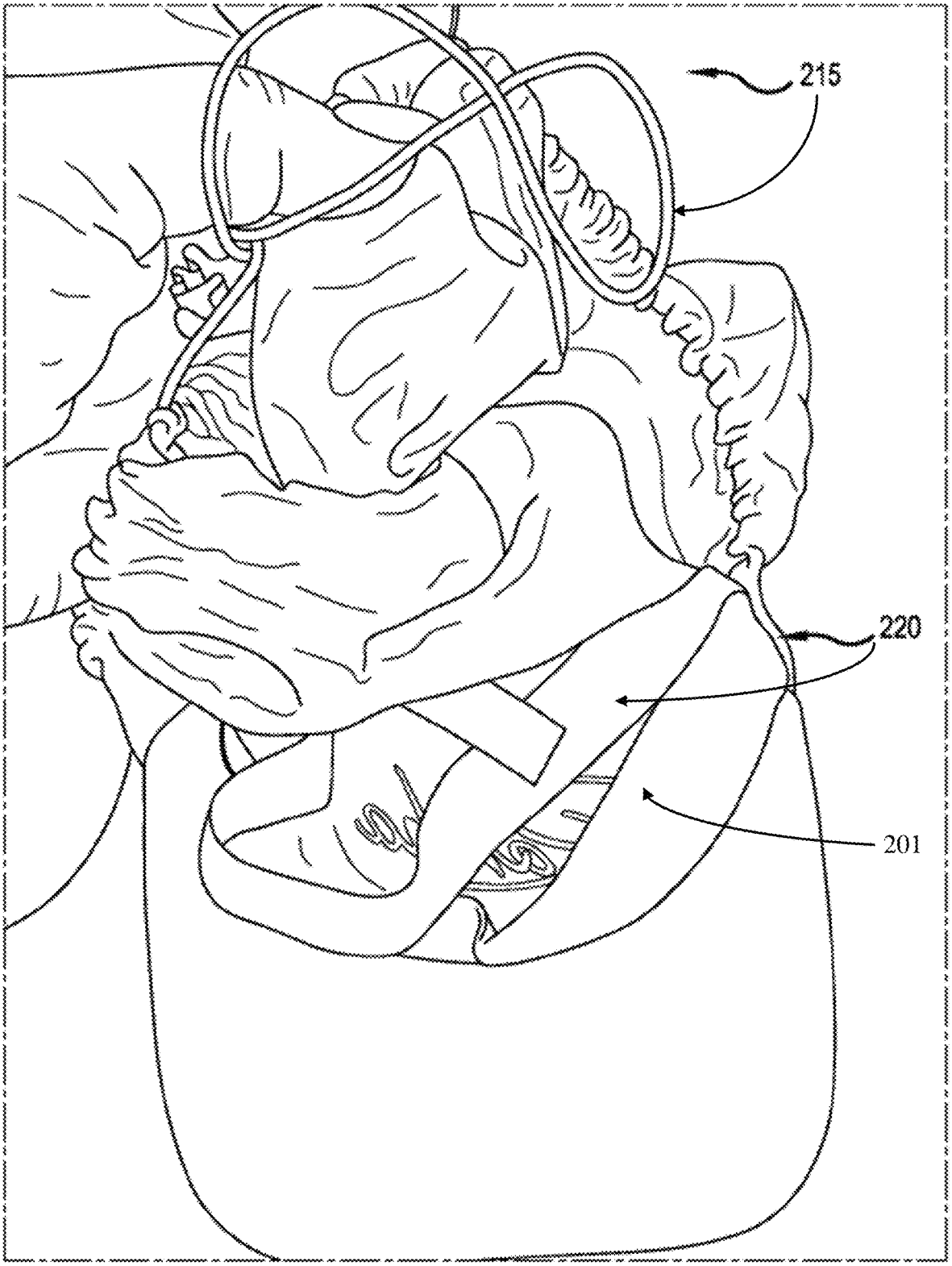
FIG. 3 depicts a bottom view of an exemplary multi-purpose bonnet styled baseball cap head covering.

Referring now to FIG. 3, there is depicted a bottom view of an exemplary multi-purpose bonnet styled baseball cap head covering. FIG. 3 shows a hat band 220 and an adjustable drawstring 215. The multi-purpose bonnet styled baseball cap head covering 100 can be configured with an adjustable drawstring 215 that closes the multi-purpose bonnet styled baseball cap head covering 100 around the wearer's head.

In at least one embodiment, the multi-purpose bonnet styled baseball cap head covering 100 can be configured without an adjustable drawstring 215 that closes the multi-purpose bonnet styled baseball cap head covering 100 around the wearer's head. In at least one instance, the multi-purpose bonnet styled baseball cap head covering 100 can be pre-sized and not have a drawstring. In at least one embodiment, the multi-purpose bonnet styled baseball cap head covering 100 comprises a satin lined interior and an elastic band for the bottom surface of the multi-purpose bonnet styled baseball cap head covering.

The invention generally relates to multi-purpose bonnet styled baseball cap head covering which may be manufactured with appropriate materials and processes, and which may be scaled as needed to accommodate a variety of hair styles, hair types, head shapes, and head sizes.

Regarding the components and function of the multi-purpose bonnet styled baseball cap head coverings, the various components may comprise the following materials including but not limited to woven fabric (e.g., cotton, wool, polymer (e.g., polyester, polyamide, polyolefin, and blends thereof)), nonwoven fabric (e.g., microfibers), polymers (e.g., synthetic elastomers, natural rubber, polyamide, polyester, polyolefin, and combinations thereof), leather, fibers, rope, yarn, ribbon, and combinations thereof.

Alternatives and Wearable Methods

In at least one embodiment, the multi-purpose bonnet styled baseball cap head covering 100 may be configured with various closure types in the rear that determines fit and adjustability. This may include but is not limited varieties of drawstrings, buckles, straps, hooks, hook and loop fasteners. In at least one embodiment, the multi-purpose bonnet styled baseball cap head covering 100 may be configured with various fabric bands for the cap sweatbands 201, inner seam taping, and the likeness thereof made from materials including but not limited to woven fabric (e.g., cotton, wool, polymer (e.g., polyester, polyamide, polyolefin, and blends thereof)), nonwoven fabric (e.g., microfibers), polymers (e.g., synthetic elastomers, natural rubber, polyamide, polyester, polyolefin, and combinations thereof), leather, fibers, rope, yarn, ribbon, and combinations thereof.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior present disclosure. Further, the dates of publication provided herein can be different from the actual publication dates, which can require independent confirmation.

The patentable scope of the present disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Insofar as the description above and the accompanying drawing disclose any additional subject matter that is not within the scope of the claims below, the disclosures are not dedicated to the public and the right to file one or more applications to claims such additional disclosures is reserved.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

The invention claimed is:

1. A multi-purpose bonnet styled baseball cap head covering, the multi-purpose bonnet styled baseball cap head covering comprising:

a front portion of the multi-purpose bonnet styled baseball cap head covering having a brim portion, a front panel, a back panel, an apex, and a closure;

wherein the front portion of the multi-purpose bonnet styled baseball cap head covering further comprises a front right panel, a front left panel, a right panel, a left panel;

a sweatband under the brim portion radially positioned and configured to fit against a wearer's brow forming an inner underside of the front portion of the multi-purpose bonnet styled baseball cap head covering;

an inner lining wherein the inner lining comprises at least one or more of satin, a satin blend, a rayon, a silk, a silk blend, and a synthetic satin;

a back portion of the multi-purpose bonnet styled baseball cap head covering having a bonnet styled rear portion, a hat band, wherein the hat band is positioned at a base of the bonnet styled rear portion of the multi-purpose bonnet styled baseball cap head covering;

wherein a middle portion of the hat band is not fixed to the head covering and extends along the underside of the head covering to receive hair through an aperture between the hat band and the closure;

wherein the bonnet styled rear portion of the cap is expansive and extends parallel to a neck of the user, to form a bonnet at the back portion of the multi-purpose bonnet styled baseball cap head covering wherein the back portion of the multi-purpose bonnet styled baseball cap head is configured to form the bonnet; and wherein the closure configured to fasten the rear portion of the multi-purpose bonnet styled baseball cap head covering wherein the closure is a fastener comprising at least one of an elastic band, an adjustable drawstring, and a hook and loop fastener strap.

2. The multi-purpose bonnet styled baseball cap head covering of claim 1, wherein the closure is an adjustable closure system configured such that it closes the multi-purpose bonnet styled baseball cap head covering around a wearer's head.

3. The multi-purpose bonnet styled baseball cap head covering of claim 1, wherein the hat band is pre-sized to one or more sizes measured to fit a radial circumference of a user's head.

4. The multi-purpose bonnet styled baseball cap head covering of claim 1, wherein the multi-purpose bonnet styled baseball cap head covering is configured to position a user's hair under the hat band and cover a user's head with the bonnet styled rear portion.

5. The multi-purpose bonnet styled baseball cap head covering of claim 4, wherein the bonnet styled rear portion of the cap is sized to receive the hair of the user.

6. The multi-purpose bonnet styled baseball cap head covering of claim 1, wherein the multi-purpose bonnet styled baseball cap head covering is configured to accommodate a variety of hair styles, hair types, head shapes, and head sizes.

7. The multi-purpose bonnet styled baseball cap head covering of claim 1, wherein the inner liner further comprises one or more woven fabrics, cotton, wool, polymers, polyester, polyamide, polyolefin, and blends thereof, non-woven fabric, microfibers, synthetic elastomers, natural rubber, polyamide, polyester, polyolefin, and combinations thereof, leather, fibers, rope, yarn, ribbon, and combinations thereof.

8. The multi-purpose bonnet styled baseball cap head covering of claim 1, wherein the closure further comprises one or more closure types in the rear that determines fit and adjustability.

9. The multi-purpose bonnet styled baseball cap head covering of claim 8, wherein the one or more closure types further comprise at least one of drawstrings, buckles, straps, hooks, hook and loop fasteners.

10. The multi-purpose bonnet styled baseball cap head covering of claim 1, wherein the hat band further comprises at least one of a fabric band, a sweatband, an inner seam taping, a headband, and a ribbon.

* * * * *